US006581577B1

(12) United States Patent
Geyer

(10) Patent No.: US 6,581,577 B1
(45) Date of Patent: Jun. 24, 2003

(54) PUMP ARRANGEMENT FOR PROVIDING FUEL AT HIGH PRESSURE

(75) Inventor: Gerhard Geyer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/786,922

(22) PCT Filed: Jun. 8, 1999

(86) PCT No.: PCT/DE99/01664

§ 371 (c)(1),
(2), (4) Date: Mar. 12, 2001

(87) PCT Pub. No.: WO00/20753

PCT Pub. Date: Apr. 13, 2000

(30) Foreign Application Priority Data

Oct. 7, 1998 (DE) ..... 198 46 157

(51) Int. Cl.[7] ..... F02M 37/04
(52) U.S. Cl. ..... 123/514; 123/446
(58) Field of Search ..... 123/446, 467, 123/510, 511, 514

(56) References Cited

U.S. PATENT DOCUMENTS 4,554,903 A * 11/1985 Straubel et al. ..... 123/446
5,701,873 A * 12/1997 Schneider ..... 123/516
6,293,253 B1 * 9/2001 Arnold ..... 123/458

FOREIGN PATENT DOCUMENTS

DE 195 49 108 * 7/1997
DE 196 30 938 * 2/1998

* cited by examiner

*Primary Examiner*—Thomas N. Moulis
(74) *Attorney, Agent, or Firm*—Ronald E. Greigg

(57) ABSTRACT

Disclosed is a high-pressure assembly for a fuel injection system, including a low-pressure pump, which aspirates fuel from a fuel tank, and a high-pressure pump with a plurality of pump elements. A feed line leads from the low-pressure pump to a suction valve of the applicable pump elements. A flow control valve of the slide type and on the outlet side of it a differential pressure valve are disposed in the feed line. Between the two valves, a return line leading to the fuel tank branches off. The differential pressure valve has an opening pressure which is greater than that of the suction valves. As a result, upon zero pumping of the high-pressure pump, an aspiration of fuel by the pump elements is averted, while in partial filling operation of the high-pressure pump, a largely uniform filling of the pump elements with fuel is achieved.

2 Claims, 1 Drawing Sheet

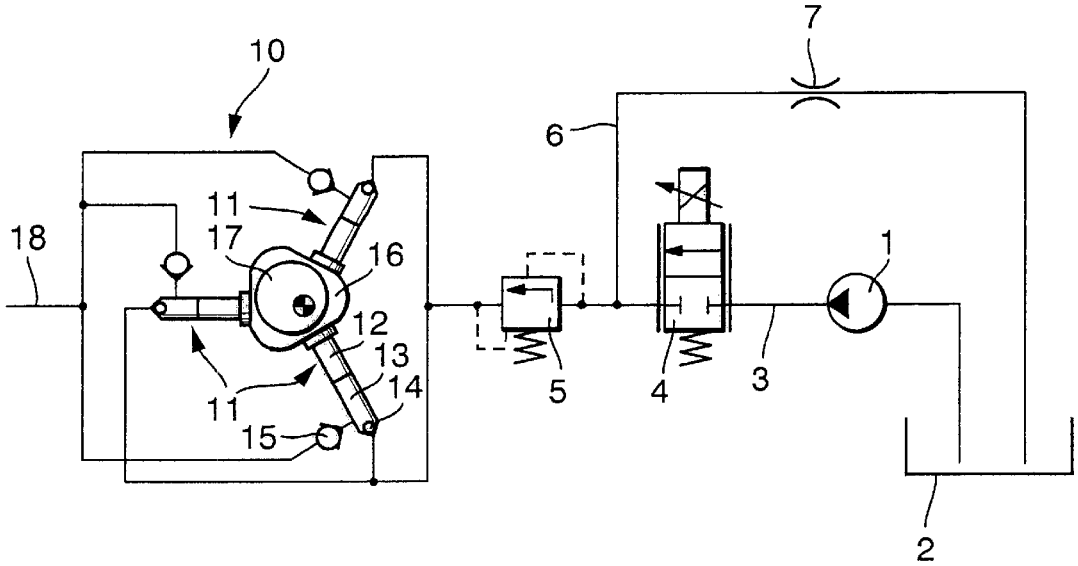
10
11
17
16
18
12
13
14
11
15
5
4
3
6
7
1
2

PUMP ARRANGEMENT FOR PROVIDING FUEL AT HIGH PRESSURE

Cross-Reference to Related Applications

This application is a 35 USC 371 application of PCT/DE 99/01664 filed on Jun. 08, 1999.

BACKGROUND OF THE INVENTION

1. Field of the Invention

This invention is directed to an improved pump assembly, and more particularly to an improved high-pressure pump for a fuel injection system for an internal combustion engine.

2. Description of the Prior Art

One pump assembly of the type with which this invention is concerned is already known from German Patent Disclosure DE 195 49 108 A1, in this known pump the flow control valve, in its position that blocks the supply flow to the high-pressure pump, diverts the fuel, brought from the low-pressure pump, to the fuel tank. A flow control valve of the slide type has a more or less major leakage flow, because of its design. In the "zero pumping" operating state of the high-pressure pump, however, the aspiration of the leakage flow by one or more of the pump elements of the high-pressure pump should be avoided. This requires setting the suction valves of the high-pressure pump to a relatively high opening pressure, with the disadvantageous consequence that in the "partial filling" operating state, opening pressure and flow tolerances lead to a non-uniform filling of the pump elements and thus a non-uniform pumping on the part of the high-pressure pump. Varying wear behavior of the suction valves over the service life of the pump can cause further impairment of the equal pumping.

SUMMARY

The pump assembly according to the invention, has the advantage over the prior art that the high-pressure pump, in the "zero pumping" operating state, does not pump any fuel, since the differential pressure valve is not overcome by the leakage flow of the flow control valve. Accordingly, the suction valves of the high-pressure pump can be set to a very low opening pressure, which in turn assures the uniform filling of the pump elements with fuel in the "partial filling" operating state. Tolerances and changes in opening pressure over the service life of suction valves set in this way have only slight influence on the equal pumping of the pump elements.

BRIEF DESCRIPTION OF THE DRAWING

One exemplary embodiment of the invention is shown, schematically simplified, in the single figure of the drawing, in the form of a hydraulic circuit diagram for a pump assembly for high-pressure fuel production and is described in further detail in the ensuing description.

DESCRIPTION OF THE PREFERRED EMBODIMENT

The pump assembly for high-pressure fuel production shown is intended for a fuel injection system, in particular a common rail injection system, used in internal combustion engines. The pump assembly has a low-pressure pump 1, which on the intake side is connected to a fuel tank 2 that for instance contains diesel fuel. From the low-pressure pump 1, a feed line 3 extends on the pressure side, and in it, a flow control valve 4 and a differential pressure valve 5 are disposed downstream in succession. Between the flow control valve 4 and the differential pressure valve 5, a return line 6 leading to the fuel tank 2 extends away from the feed line 3. A throttle 7 is disposed in the return line 6.

The pump assembly further includes a high-pressure pump 10 with three pump elements 11. Each of these pump elements has one pump piston 12, one suction valve 14, and one compression valve 15, connected to a positive displacement chamber 13 of the pump element 11. The pump pistons 12, braced by spring force on a stroke ring 16, can be driven by an eccentric shaft 17, which like the low-pressure pump 1 is coupled to the engine, not shown. After a branch on the downstream side of the differential pressure valve 5, the feed line 3 is connected to the suction valves 14 of the pump elements 11. Line branches of a high-pressure fuel line 18, which leads to a high-pressure fuel reservoir, not shown, of the fuel injection system originate at the compression valves 15 of the pump elements 11. The low-pressure pump 1 and the high-pressure pump 10 of the pump assembly are each protected against an overload by pressure limiting valves, not shown.

The fuel aspirated from the fuel tank 2 by the low-pressure pump 1 is metered quantitatively by the flow control valve 4, embodied as a proportional magnet valve, and dispensed through the opened differential pressure valve 5 to the high-pressure pump 10. The high-pressure pump raises the pressure of the pumped fuel to a relatively high pressure level and feeds it through the high-pressure fuel line 18 into the fuel reservoir, to which fuel injectors of the engine are connected. A slight portion of the supply flow of the low-pressure pump 1, downstream of the flow control valve 4, returns to the fuel tank 2 through the throttled return line 6. The pumping of the high-pressure pump 10 that depends on the fuel demand of the engine is known as quantity regulation by intake throttling set with the flow control valve 4.

In terms of design, both the low-pressure pump 1 and the high-pressure pump 10 are constant pumps.

The suction valves 14 of the pump elements 11 of the high-pressure pump 10 are embodied, as schematically shown in simplified form, as unloaded check valves. In a departure from what is shown, the suction valves 14 can also be embodied as spring-loaded check valves. What is essential to the invention, however, is that the suction valves 14 are set to a very low opening pressure. By comparison, the differential pressure valve 5 in the feed line 3 has an opening pressure that is greater than that of the suction valves 14. The flow control valve 4 disposed upstream of the differential pressure 5 valve 5 in the feed line 3 is of the slide design and accordingly has a fuel leakage flow in its closing position; this leakage flow is diverted, downstream of the flow control valve, into the throttled return line 6, without switching the differential pressure valve to its open position.

In the blocking position of the flow control valve 4, the differential pressure valve 5 therefore assures that the pump elements 11 cannot aspirate any fuel, and the high-pressure pump 10 functions in the "zero pumping" operating state. For a "partial pumping" operating state, a fuel supply flow whose pressure switches the differential pressure valve 5 over is set by means of the flow control valve 4, so that the pump elements 11 can aspirate fuel and dispense it into the high-pressure fuel line 18. As a result of the low opening pressure of the suction valves 14, uniform filling of the pump elements 11 is achieved. With the equal pumping of the pump elements 11, pressure fluctuations in the high-pressure fuel container are largely averted.

The foregoing relates to preferred exemplary embodiments of the invention, it being understood that other variants and embodiments thereof are possible within the spirit and scope of the invention, the latter being defined by the appended claims.

I claim:

1. In a pump assembly for high-pressure fuel production for a fuel injection system used in internal combustion engines, in particular a common rail injection system, having a low-pressure pump (1) that aspirates fuel from a fuel tank (2), a high-pressure pump (10) with a plurality of pump elements (11), a feed line (3), leading from the low-pressure pump (1) to the high-pressure pump (10), to which line a suction valve (14) of the applicable pump element (11) is connected, a flow control valve (4) of the slide type in the feed line (3), and having a return line (6) connected to the outlet side of the flow control valve (4), the improvement wherein the return line (6) is connected to the feed line (3) between the flow control valve (4) and the high-pressure pump (10); and a differential pressure valve (5), whose opening pressure is greater than that of the suction valves (14), is disposed in the feed line (3) between the connection of the return line (6) and the suction valves (14) of the high-pressure pump (10).

2. The pump assembly of claim 1, wherein the suction valve (14) of the pump elements (11) is an unloaded or a spring-loaded check valve.

* * * * *